United States Patent [19]

Majerus et al.

[11] Patent Number: 4,499,830

[45] Date of Patent: Feb. 19, 1985

[54] HIGH LETHALITY WARHEADS

[75] Inventors: John N. Majerus, Rising Sun, Md.; William P. Walters, Newark, Del.

[73] Assignee: The United States of America as represented by the Secretary of the Army, Washington, D.C.

[21] Appl. No.: 280,585

[22] Filed: Jun. 29, 1981

[51] Int. Cl.[3] ..... F42B 13/12

[52] U.S. Cl. ..... 102/476; 102/307; 102/309

[58] Field of Search ..... 102/306–310, 102/476

[56] References Cited

U.S. PATENT DOCUMENTS

| | | | |
|---|---|---|---|
| 2,595,960 | 5/1952 | Lawrence | 102/306 |
| 3,224,368 | 12/1965 | House | 102/306 |
| 3,238,872 | 3/1966 | Zernow et al. | 102/306 |
| 3,732,816 | 5/1973 | Müller | 102/306 |
| 3,736,875 | 6/1973 | Bucklishch | 102/309 |
| 3,789,760 | 2/1974 | Griffith | 102/306 X |
| 3,802,342 | 4/1974 | Berlot et al. | 102/309 |
| 4,004,515 | 1/1977 | Mallory et al. | 102/308 |
| 4,041,866 | 8/1977 | Theyinen et al. | 102/306 |
| 4,080,898 | 3/1976 | Gieske | 102/306 |
| 4,160,412 | 7/1979 | Snyer et al. | 102/307 |

FOREIGN PATENT DOCUMENTS

| | | | |
|---|---|---|---|
| 2706060 | 8/1978 | Fed. Rep. of Germany | 102/306 |

*Primary Examiner*—Peter A. Nelson

*Attorney, Agent, or Firm*—Anthony T. Lane; Robert P. Gibson; Harold H. Card, Jr.

[57] ABSTRACT

A shaped-charge warhead increases the lethality of the liner material by introducing a lethal material into an appropriate region of a jet penetrator so that the lethal material is projected on the shot-line ahead of a normally large slow-moving slug, or rearward portions of the stretching jet penetrator, without hindering the actual penetration process of an outer vehicle armor. The improved shaped-charge liner eliminates the necessity of using naturally pyroforic material or poisonous liquids.

9 Claims, 14 Drawing Figures

10
12
20
14
16
18

10
12
14
16
18d 28
26'
26'
30
30
26
26

10
12
20
14
16
18a 16
24
16
28
26'
24
26

10
12
14
16
18b

30

28
10
12
14
16
18c 10
12
14
21
18e
22

28
26'
26'
30
30
26
26

HIGH LETHALITY WARHEADS

GOVERNMENTAL INTEREST

The invention described herein may be manufactured, used and licensed by or for the Government for Governmental purposes without the payment to us of any royalty thereon.

BACKGROUND OF THE INVENTION

Various means have been used in the prior art to design warheads with a "follow-through" capability for effectively attacking a target behind protective armor. These prior art means have included warheads having a shaped-charge which attempted to first punch a hole through the armor and then follow-up by either starting fires or injecting lethal fluid chemicals. Some of these prior art shaped-charge devices attempted to solve this problem by using bimetallic liners using naturally pyroforic materials, such as zirconium. These shaped-charge warheads comprised the usual combination of a hollow explosive lined with a metal. The metal liner was composed of an inner metal material, such as copper or aluminum, and an outer liner metal made of pyroforic metal. The inner liner material formed the stretching jet, whereas most of the outside liner material went into a slow-moving rearward slug. The stretching jet was designed to form a hole through the outside armor of a vehicle through which the pyroforic slug could then enter to defeat the target. The problem with this type of shaped-charge warhead was that the slug was frequently too large to pass through the hole in the outside armor. Other prior-art devices attempted to solve this problem by using a bimetallic liner wherein the naturally pyroforic material was used on the inside of the liner. However, the problem with these devices was that the naturally pyroforic material does not form good stretching jets and, thus, their ability to make a hole through outside armor is quite low.

Other prior-art shaped-charge warhead projectiles attempted to produce an effective follow-through capability by using a follow-through projectile that was supposed to enter the armored vehicle through the hole produced by the stretching jet. The follow-through projectile was found to work only if the follow-through projectile impacted the target without pitch or yaw, the vehicle armor was relatively thin, the follow-through projectile did not get stuck in the armor, and guides were used for the follow-through projectile. The problem with these shaped-charge follow-through projectile munitions was that the guides added considerable weight to the projectile. Prior-art shaped-charge munitions using fluid flow-through means were also not successful because almost all of the fluid was dispersed on the outside surface of the vehicle armor even when the armor was relatively thin.

Another problem with prior-art shaped-charge devices has been that, because of the small diameter of the shaped-charge jet, there was a corresponding small probability of hitting crew members in an armored vehicle. The probability of catastrophic defeat of an armored vehicle depends critically upon the impacting munition ability to cause ammunition within the vehicle to explode or burn, igniting the vehicle's fuel, or generating steel debris, called spall, off the exit side of the perforated armor. The steel debris moves in a divergent fashion from the shot-line and, hence, can lethally encompass a large percentage of the crew compartment.

PRIOR ART DISCLOSURE STATEMENT

Typical prior art approaches may be seen by example in U.S. Pat. No. 3,732,816; U.S. Pat. No. 4,004,515 and U.S. Pat. No. 4,080,898.

In U.S. Pat. No. 3,732,816, there is described a liner insert for a shaped-charge whose wall thickness increases progressively or diminishes degressively starting from the axis toward the insert base and has outer and inner generating lines which are completely or partly curved lines. This concept is opposite to the concept disclosed in the present application which provides for an insert of "lethal" material at an appropriate region within the main penetrator so that the lethal material is ahead of the large slow-moving slug, or rearward portions of the penetrator.

In U.S. Pat. No. 4,004,515, a plurality of serially spaced shaped-charges utilize a flat metal washer at the base of each upper charge to clip off the slow, nonpenetrating end of each stretching jet. This concept is different than the concept in the present application which provides for only a single shape charge wherein a lethal insert is judiciously positioned in a main single liner.

In U.S. Pat. No. 4,080,898, the shape of the liner is obtained by sequentially winding wire or rod about a preformed mandrel and held in proper position by the use of an adhesive or solder. This concept is different from the concept in the present invention in that there is no lethal material which is capable of being projected ahead of a large relatively slow-moving slug.

SUMMARY OF THE INVENTION

The present invention relates to an improved shaped-charge warhead. A primary objective of the present invention is to increase the lethality of shaped-charge warheads, or self-forging fragments, by introducing a lethal material into an appropriate region in a shaped-charge liner or penetrator. The lethal material is radially positioned in the liner to provide a "follow-through" effect which greatly enhances the warhead effectiveness by either causing a violent reaction with the ammunition or fuel stored inside the target, or by incapacitating the crew of an armored vehicle.

An object of the present invention is the judicious location of lethal material in the liner so that the lethal material is ahead of the relatively large, slow-moving slug, or rearward portions of the penetrator without hindering the actual penetration process of a vehicle's outer armor.

Another object of the present invention is to provide a shaped-charge liner for a high lethality warhead, wherein the lethal "follow-through" element does not have to be made of a naturally pyroforic material.

Another object of the present invention is to provide a shaped-charge liner, wherein the lethal "follow-through" element is not a poisonous fluid.

A further object of the present invention is to provide a shaped-charge munition which is easier to manufacture and safer to handle.

For a better understanding of the present invention, together with other and further objects thereof, reference is made to the following descriptions taken in connection with the accompanying drawings.

BRIEF DESCRIPTION OF THE DRAWINGS

Throughout the following description, like reference numerals are used to denote like parts of the drawings.

DESCRIPTION OF THE PREFERRED EMBODIMENTS

Figures 1A, 1B, 1C, 2A, 2B, 3A, 3B, 4A, 4B, 4C:
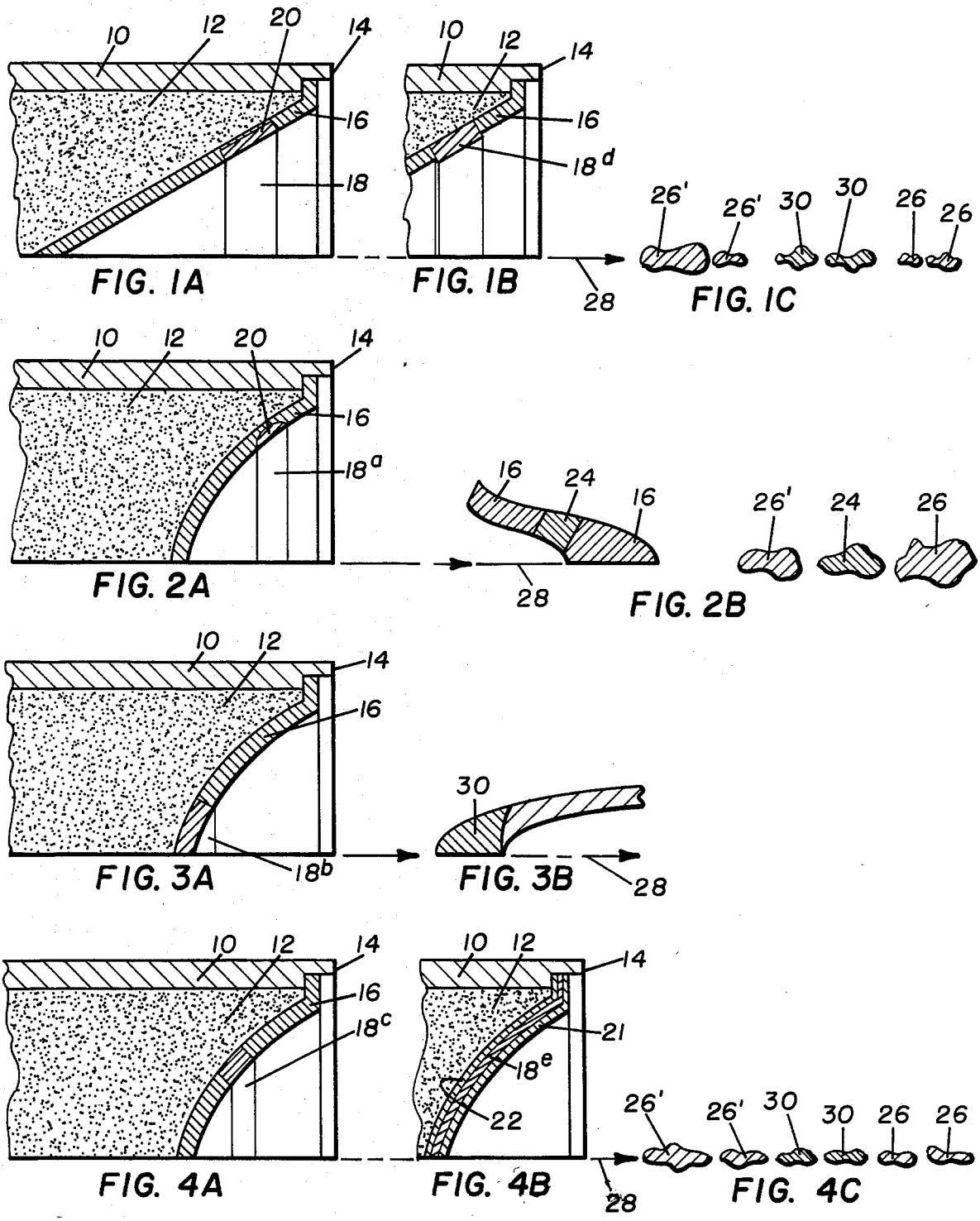
FIG. 1A is a partial diametral cross-sectional view of a conical shaped-charge illustrating one of the preferred embodiments of the present invention.
FIG. 1B is a partial diametral cross-sectional view of another conical shaped-charge embodiment.
FIG. 1C is a schematic view of how the slug material is sized and sequenced by the configurations of FIG. 1A and 1B.
FIG. 2A is a partial diametral cross-sectional view of a semi-hemispherical shaped-charge which utilizes a forward folding self-forging lethal slug fragment.
FIG. 2B is a schematic illustration of the slug formation and sequence of fragment formation from the embodiment of FIG. 2A.
FIG. 3A is a partial diametral cross-sectional view of a semi-hemispherical shaped-charge which utilizes a backward folding self-forging lethal slug fragment.
FIG. 4A is a partial diametral cross-sectional view of another embodiment of a semi-hemispherical shaped-charge having a lethal material distribution oriented in the liner similar to the embodiment of FIG. 1B.
FIG. 4B is another modification of the semi-hemispherical shaped-charge showing the lethal material sandwiched between liner materials.
FIG. 4C is a schematic view of the slug material form and sequence generated by the embodiment of FIG. 4B.

Referring now to FIGS. 1A, 1B, 2A, 3A, and 4A, the shaped-charge warheads have a cylindrical body member 10 which has an explosive holding cavity filled with an explosive material 12 and a forward end 14 operatively closed off by a concavely-shaped metal liner 16. Liner 16 may be made of such material as copper and aluminum. Note that the inclosure described by numeral 14 in FIGS. 1A, 2A, 3A and 4A may be represented as an ogive, conical or hemispherical cap over the base of the liner. This inclosure is designed to provide a built-in standoff distance for the shaped-charge warhead and to provide an aerodynamic fairing during the flight of the missile. This is well known technology within the prior art, the ogive configuration being the most popular.

Referring to embodiments of FIGS. 1A and 2A, an annular strip of lethal material 18 and 18$^a$, is fixedly disposed in exterior wall lethal groove 20. The lethal material 18$^b$, and 18$^c$ may be made as a strip which is the full thickness of the liner 16, as shown in FIGS. 3A and 4A, or thicker than the liner material 16 as shown in FIG. 1B by lethal material 18$^d$.

A further modification shows the lethal material 18$^e$ sandwiched between inner liner material 21 and outer liner material 22. The cross-sectional shape of the lethal material 18$^a$ shown in FIG. 2B will tend to produce a forward folding, self-forging fragment 24 positioned intermediate liner fragments 26 and 26'. Fragment 26 under the influence of heat, shock and pressure forces of explosive 12 will become a vaporized stretching jet along shot-line 28. The stretching jet has been described and is well-known in the prior art. The liner fragment 26' produces a large slow-moving slug, or rearward portions of the penetrator. The configuration and position of liner material 16 and lethal material 18$^b$ shown in the embodiment of FIG. 3A will produce a backward folding self-forging fragment 30 shown in FIG. 3B.

The embodiments of FIGS. 1A, 1B, 4A and 4B are designed to produce a plurality of lethal material fragments 30 along shot-line 28. Lethal fragments 30 are sequentially explosively projected along the shot-line 28 with the leading liner material fragments 26 as previously stated, becoming the stretching jet and the following liner fragments 26' becoming a slug of material.

Figure 5:
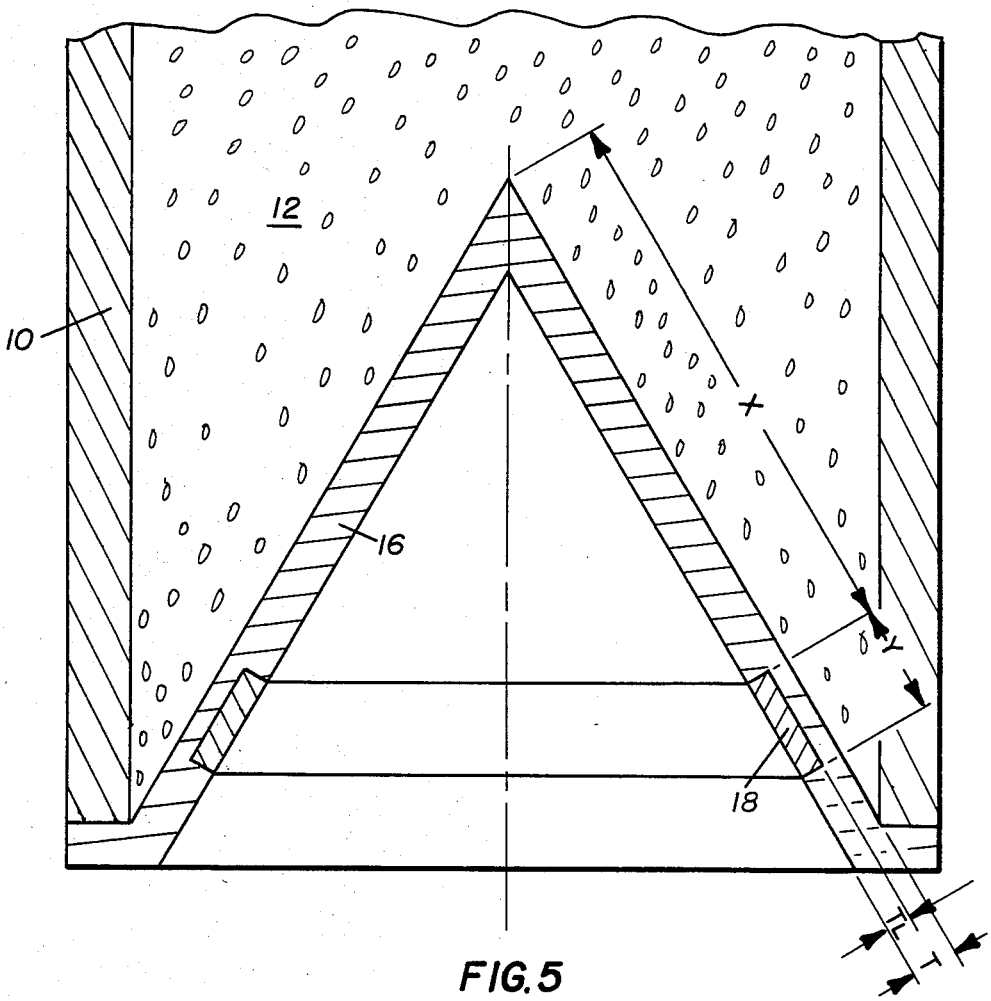
FIG. 5 is a cutaway diametral cross-sectional view of a conical shaped-charge similar to the embodiment shown in FIG. 1A.

The geometric variables associated with a high lethality conical shaped-charge warhead are shown in FIG. 5. The method of utilizing the lethal material for the conical shaped-charge and the semi-hemispherically lined shaped-charge, or the self-forging fragment modifications of either the forward folding or the backward folding designs, are similar.

Referring now to FIG. 5, the variables of the design for a high lethality shaped-charge warhead include the axial or radial location of the lethal material 18 within the liner material 16 as determined by the distance "X" from the apex of the liner to the beginning edge of the annular lethal strip 18, the thickness "T" of the liner material 16, the thickness "TL", length "Y", density, and kinematic viscosity of the lethal material 18.

Figure 6:
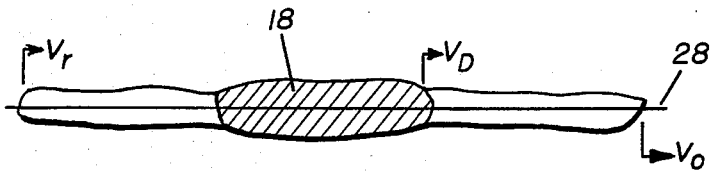
FIG. 6 is a schematic diagram of the stretching jet penetrator or self-forging fragment in flight through air.
Figure 7:
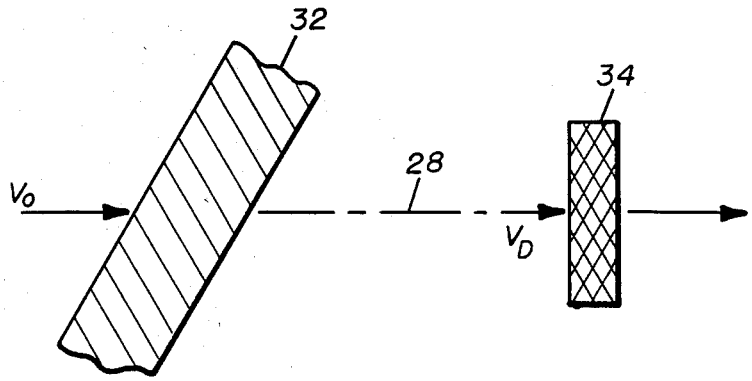
FIG. 7 is a schematic drawing showing the velocity interrelationship and location along the shot-line of the penetrator.

Referring now to FIGS. 6 and 7, the aforementioned variables are selected so that, after the liner 16 has collapsed and the projectile fragment has formed, the velocity of the front segment of the lethal material corresponds to the desired velocity $V_D$ along the path of the penetrator. Existing calculational methods as discussed in "Theory of Jet Formation by Charges With Lined Conical Cavities," in The Journal of Applied Physics, Vol. 23, No. 5, May 1952, pp. 532–536, by E. M. Pugh, R. J. Eichelberger and N. Rostoker, and in "Influence of Material Viscosity on the Theory of Shaped-Charge Jet Formation," Memorandum Report ARBRL-MR-02941, August 1979, by W. Walters, interrelate the aforementioned liner variables and the velocity at some location along the penetrator. The desired velocity at some point along the length of the penetrator corresponds to some location along the shot-line 28. The warhead can be designed, as shown in FIG. 7, so that the velocity at the front of the penetrator $V_o$ is reached when the penetrator is just at the exterior surface of the vehicle armor 32 and the desired velocity at the front of the lethal material is reached when the lethal material is at the exterior surface of the target 34 or object of interest located behind the armor 32. The method for calculating the velocity V at some location along the shot-line 28 is well-known in the art and was discussed by J. N. Majerus in BRL Report No. 1942, dated November 1976, (AD #Bo15399L) and by W. Walters and J. Majerus in the Proceedings of the Third Annual Vulnerability/Survivability Symposium, November 1977. The velocity is calculated from known penetrator characteristics of tip velocity $V_o$, rear velocity $V_r$, break-up time for stretching penetrators, stand-off distance, and the target material 34 characteristics along the shot-line 28. Thus, using velocity along the penetrator, shown schematically in FIG. 6, allows one to map liner design to jet material along the shot-line 28.

Figure 8:
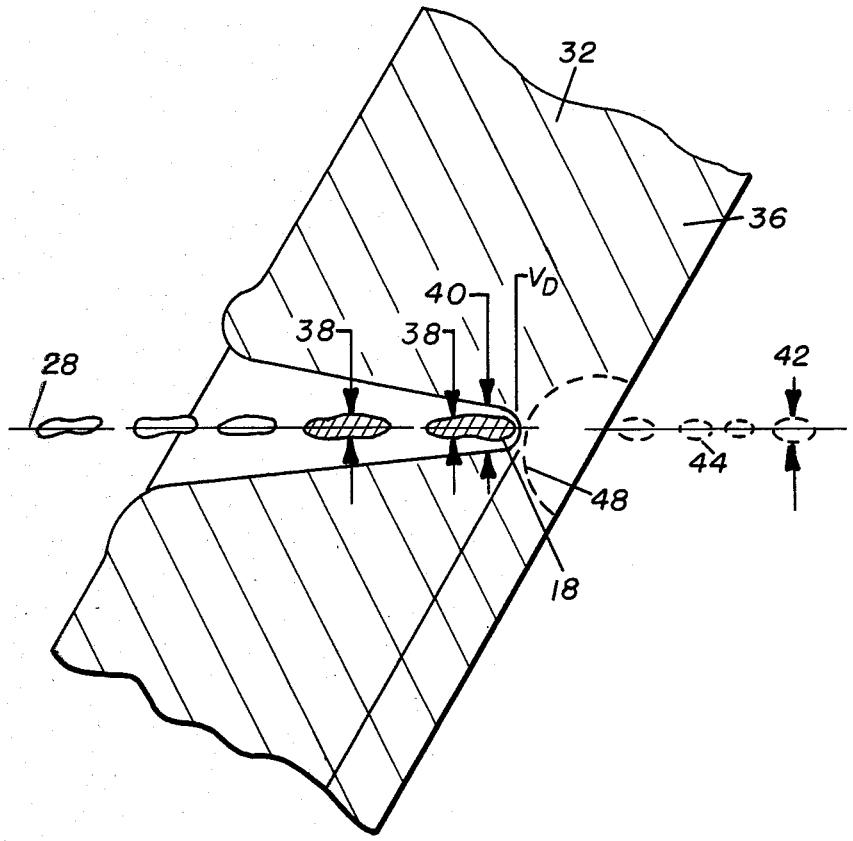
FIG. 8 is a schematic drawing illustrating utilization of lethal material for increasing the number of spall fragments off the back of an armored surface.

Referring now to FIGS. 7 and 8, showing the jet material along the shot-line 28 allows one to enhance a warhead's lethality by utilizing any or all of the following techniques:

(a) select velocity $V_D$ so that lethal material 18 impacts near the rear surface 36 of the outer vehicle armor 32;

(b) select velocity $V_D$ so that lethal material impacts onto any stored target 34 along the shot-line 28, as shown in FIG. 7;

(c) select velocity $V_D$ so that the lethal material 18 enters into the inside of the vehicle without penetrating into the outer vehicle armor 32.

The aforementioned techniques increase a shaped-charge warhead's lethality because the number and velocity of spall fragments, not shown, off the rear surface 36 of the vehicle outer armor 32 increases with increasing rate of jet-energy. This deposited energy increases linearly with jet density and to the second power of jet radius and velocity. Since the jet velocity is fixed at $V_D$, the deposited energy can increase most readily by increasing the diameter 38 of the impacting jet particles 18. Experiments and analyses have shown that the armor hole diameter 40 is 3 to 10 times the diameter 42 of the previous nonlethal jet particles 44; therefore, the diameter 38 of the impacting lethal material should be limited to approximately twice the diameter of the previous nonlethal jet particles 44. Hence, by a gradation in the size, length and diameter of the lethal fragments 18, a considerable increase in the number of spall fragments can be achieved from the exit side 36 of the perforated armor spall area 46 enclosed within hemispherical dashed line 48. The length and diameter of the lethal particles are controlled by the design variables aforementioned. An increase in the number of spall fragments can also be achieved by increasing the density of the lethal material. The lethal fragments may be made of relatively inert material, such as steel, or naturally pyroforic material, such as magnesium, zirconium, or materials which create a chemically toxic debris, such as lead, tantalum, uranium or beryllium.

Figure 9:
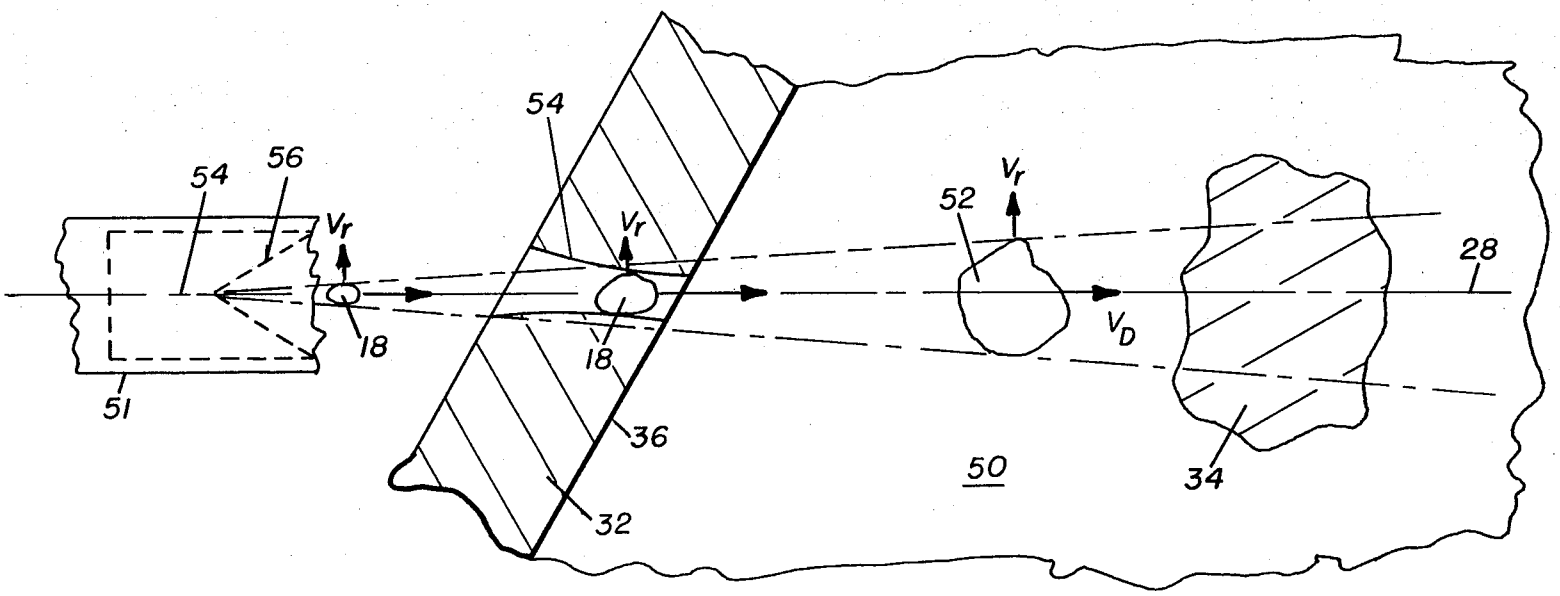
FIG. 9 is a schematic drawing illustrating usage of lethal material as an expanding debris for enhanced particles within a vehicle.

Referring now to the schematic drawing FIG. 9, the amount and type of debris entering the inside area 50 of a vehicle, not shown, from shaped-charge 51 can be made additive to the steel spall-fragments associated with the exit side 36 of perforated armor 32. This can be accomplished if the lethal material entering the vehicle is not a solid mass, but rather a forward-moving dispersed fragment array 52. Particle array 52 is designed to have a radial velocity component indicated by arrow $V_r$ which causes lethal material 18 to disperse radially along shot-line 28. Although some particles will strike the side of the hole 54 in the armor 32, most particles will disperse inside the vehicle since the armor thickness is much smaller than the interior dimension along shot-line 28 from the rear surface 36 to the object target 34 of interest. The desired radial velocity $V_r$ of the lethal material 18 can be achieved by (1) overdriving the lethal material around the center line 54 of the shaped-charge 56, or (2) by rotationally shear forming a zone of lethal material, or (3) by using a brittle material, such as tungsten, or the lethal substance, or (4) by using a material such as Wood's metal or lead which nearly vaporizes under the shock heating induced by the liner collapse process.

The foregoing disclosure and drawings are merely illustrative of the principles of this invention and are not to be interpreted in a limiting sense. We wish it to be understood that we do not desire to be limited to the exact details of construction shown and described because obvious modifications will occur to a person skilled in the art.

We claim:

1. A lethal warhead for use against a target protected by vehicle outer armor which comprises:

a cylindrical body member having an explosive holding cavity therein and a forward end;

explosive means disposed in the holding cavity of said body member;

liner means fixedly disposed in said forward end of said body member for generating jet means and slug means for penetrating said armor which includes;

a conically-shaped metal liner having an annular groove disposed in an exterior wall of said liner means further including:

an arcuate-shaped metal liner; and lethal means which includes an annular strip of lethal material fixedly disposed in said annular groove of said liner means, for providing a plurality of "follow-through" particles to violently interact with said target.

2. A lethal warhead as recited in claim 1 wherein said lethal means includes a strip of lethal material which is at least as thick as the wall of said liner means and operatively positioned therein to provide a backward folding self-forging fragment.

3. A lethal warhead as recited in claim 1 wherein said lethal means includes an arcuate shaped member sandwiched between liner means.

4. A lethal warhead as recited in claim 1 wherein said explosive means, liner means and lethal means dimensions are selected so that after said liner means collapses, a front segment of said lethal material acquires a velocity $V_D$ along the length of a stretching jet formed from said liner means.

5. A lethal warhead as recited in claim 4 wherein said explosive means, liner means, lethal means dimensions and said velocity $V_D$ are selected so that said lethal material impacts proximate to the rear surface of said vehicle outer armor.

6. A lethal warhead as recited in claim 5 wherein said explosive means, liner means, lethal means dimensions and said velocity $V_D$ are selected so that said lethal material impacts said target along a shot-line of said warhead.

7. A lethal warhead as recited in claim 6 wherein said explosive means, liner means, lethal means dimensions and velocity $V_D$ are selected so that said lethal material enters inside of said vehicle without penetrating into said vehicle outer armor.

8. A lethal warhead as recited in claim 7 wherein said explosive means, liner means, lethal means dimensions and velocity $V_D$ are selected so that said lethal material produces fires, toxicity effects, spall fragment distribution or other forms of behind the armor lethality.

9. A lethal warhead as recited in claim 8 wherein said explosive means, liner means, lethal means dimensions and velocity $V_D$ are selected so that said lethal material increases the violence of the chemical reaction between the residual penetrator and any propellant, fuel, or explosive which the penetrator impacts.

* * * * *